US011840111B2

(12) United States Patent
Stierman et al.

(10) Patent No.: US 11,840,111 B2
(45) Date of Patent: Dec. 12, 2023

(54) METHOD FOR PRODUCING BANKNOTES INCLUDING IN EACH CASE AT LEAST ONE INTEGRATED CIRCUIT

(71) Applicant: KOENIG & BAUER AG, Würzburg (DE)

(72) Inventors: Robert Stierman, Alphen aan den Rijn (NL); Aurélie Berthon, Villars-sous-Yens (CH); Angèle Monney, Fribourg (CH)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/613,134

(22) PCT Filed: Oct. 20, 2020

(86) PCT No.: PCT/EP2020/079470

§ 371 (c)(1),
(2) Date: Nov. 22, 2021

(87) PCT Pub. No.: WO2021/099049

PCT Pub. Date: May 27, 2021

(65) Prior Publication Data

US 2022/0212492 A1 Jul. 7, 2022

(30) Foreign Application Priority Data

Nov. 22, 2019 (DE) ..... 10 2019 131 654

(51) Int. Cl.
*B42D 25/305* (2014.01)
*B42D 25/29* (2014.01)
(Continued)

(52) U.S. Cl.
CPC ..... *B42D 25/305* (2014.10); *B42D 25/29* (2014.10); *B42D 25/351* (2014.10);
(Continued)

(58) Field of Classification Search
CPC .... B42D 25/305; B42D 25/29; B42D 25/351; B42D 25/435; B42D 25/44; B42D 25/455; B42D 25/46
(Continued)

(56) References Cited

U.S. PATENT DOCUMENTS 6,547,151 B1 4/2003 Baldi
2003/0164611 A1* 9/2003 Schneider ..... G06K 19/07749 283/57
(Continued)

FOREIGN PATENT DOCUMENTS

DE 69722403 T2 1/2004
DE 102004018081 A1 10/2005
(Continued)

OTHER PUBLICATIONS

International Search Report of PCT/EP2020/079470 dated Feb. 9, 2021.

*Primary Examiner* — Justin V Lewis
(74) *Attorney, Agent, or Firm* — Mattingly & Malur, PC

(57) ABSTRACT

A method is provided for producing banknotes, which include, in each case, at least one integrated circuit. The banknotes are produced from a sheet or from a material web in a production panel. In at least a plurality of these banknotes, or in each of these banknotes, an aperture is created through their substrate. In each case, an integrated circuit is arranged in the relevant aperture. In a first method step, each of the integrated circuits to be arranged in one of the apertures is arranged, with respect to the intended position in each of the banknotes that include an aperture, in the correct position on a band-shaped foil, and, in the second method step, each of these integrated circuits is transferred from this band-shaped foil onto the relevant banknote. Owing to this transfer carried out in the second method step, one integrated circuit in each case, is arranged in the aperture created in the banknotes.

14 Claims, 3 Drawing Sheets

(51) Int. Cl.

| | |
|---|---|
| ***B42D 25/44*** | (2014.01) |
| ***B42D 25/46*** | (2014.01) |
| ***B42D 25/351*** | (2014.01) |
| ***B42D 25/435*** | (2014.01) |
| ***B42D 25/455*** | (2014.01) |

(52) U.S. Cl.
CPC ..... *B42D 25/435* (2014.10); *B42D 25/44* (2014.10); *B42D 25/455* (2014.10); *B42D 25/46* (2014.10)

(58) Field of Classification Search
USPC .... 283/67, 72, 83, 87, 91, 94, 98, 101, 105, 283/901
See application file for complete search history.

(56) References Cited

U.S. PATENT DOCUMENTS

| | | | | |
|---|---|---|---|---|
| 2004/0065743 | A1* | 4/2004 | Doublet ..... | B42D 25/29 235/487 |
| 2005/0150740 | A1 | 7/2005 | Finkenzeller et al. | |
| 2014/0174306 | A1* | 6/2014 | Wening ..... | B42D 25/346 101/25 |

FOREIGN PATENT DOCUMENTS

| | | | |
|---|---|---|---|
| DE | 102011103000 | A1 | 11/2012 |
| EP | 1961578 | A1 | 8/2008 |
| WO | 2003/054808 | A2 | 7/2003 |
| WO | 2005098748 | A1 | 10/2005 |
| WO | 2011/003518 | A1 | 1/2011 |
| WO | 2012/159871 | A2 | 11/2012 |

* cited by examiner

METHOD FOR PRODUCING BANKNOTES INCLUDING IN EACH CASE AT LEAST ONE INTEGRATED CIRCUIT

CROSS-REFERENCE TO RELATED APPLICATIONS

This application is the US national phase, under 35 USC § 371, of PCT/EP 2020/079470, filed on Oct. 20, 2020; published as WO 2021/099049A1, on May 27, 2021, and claiming priority to DE 10 2019 131 654.5, filed on Nov. 22, 2019, the disclosures of which are expressly incorporated herein in their entireties by reference.

FIELD OF THE INVENTION

The present invention relates to a method for producing banknotes including, in each case, at least one integrated circuit. The bank notes are produced from a sheet or from a material web in a production panel. At least in a plurality of the bank notes, or in each of these banknotes, an aperture is created through the banknote's substrate.

BACKGROUND OF THE INVENTION

A standard paper banknote is known from DE 697 22 403 T2, comprising a paper-based substrate that includes at least one integrated circuit, which is applied to the paper-based substrate, or is embedded therein, as an active identification and/or authentication element of the banknote, wherein the integrated circuit provides for secure storage and exchange of information with respect to the banknote, wherein the integrated circuit is inserted into an opening of the paper-based substrate, and wherein the thickness of the integrated circuit corresponds to the thickness of the paper-based substrate and is less than 100 μm.

A method for hot stamping at least part of at least one band-shaped stamping foil onto a band-shaped substrate is known from DE 10 2011 103 000 A1, wherein the substrate to be stamped is brought together with a stamping foil of the at least one stamping foil, the substrate and the stamping foil resting thereon are guided along the circumference of a first heated stamping roller, wherein, in a first stamping, the substrate and the stamping foil resting thereon are pressed against one another and against the heated surface of the first stamping roller by at least one first pressure roller arranged at the circumference of the first stamping roller, and a first stamping layer is stamped onto the substrate, the once-stamped substrate is guided away from the first stamping roller and is again brought together with the same or a further stamping foil of the at least one stamping foil downstream from first stamping roller, based on direction of travel of the substrate, the once-stamped substrate and the stamping foil resting thereon are guided along the circumference of a second heated stamping roller, wherein, in a second stamping, the substrate and the stamping foil resting thereon are pressed against one another and against the heated surface of the second stamping roller by at least one second pressure roller arranged at the circumference of the second stamping roller, and a second stamping layer is stamped onto the substrate, and the twice-stamped substrate is guided away from the second stamping roller.

A method for producing a security paper is known from DE 10 2004 018 081 A1, comprising the following steps: a) forming a paper web on a paper screen, and b) embedding a plastic film including antenna structures into the paper web during the formation of the sheet, wherein the plastic film is a plastic film network structured in a grid-like manner.

Sheet material including a circuit as well as a device and a method for processing the same are known from US 2005/0150740 A1, which reduce the effort for processing the sheet material and/or facilitate processing and/or enhance it and/or make it more reliable. For this purpose, the sheet material has at least one circuit, wherein energy and/or data are transmitted from the device to the circuit and/or from the circuit to the device, and wherein at least part of the transmitted data is used for processing the sheet material.

SUMMARY OF THE INVENTION

It is the object of the present invention to devise a method for producing banknotes including, in each case, at least one integrated circuit, which can be carried out economically in an industrial process.

The object is achieved according to the present invention by the provision, in each case, of an integrated circuit being arranged in the relevant aperture. In a first method step, each of the integrated circuits, which is to be arranged in one of the apertures, is arranged, with respect to the intended position of each of the banknotes that includes an aperture, in the correct position on a band-shaped foil. In a second method step, each of the integrated circuits is transferred from this band-shaped foil onto the relevant banknote. Owing to this transfer, that is carried out in the second method step, one integrated circuit, in each case, is arranged in each of the apertures created in the banknote.

The advantages to be achieved with the invention are, in particular, that banknotes including in each case at least one integrated circuit can be economically produced in an industrial process. Another advantage of the identified solution is that banknotes including in each case an integrated circuit that is inserted into an aperture are more durable and sturdier during use than banknotes including an integrated circuit that is applied to the surface, and more particularly when a structural height of the integrated circuit is less than the thickness or material thickness of the substrate of the banknote in question. Furthermore, it is advantageous that an integrated circuit configured as a capacitively coupled RFID tag does not require a separate antenna. Further advantages are apparent from the following description.

BRIEF DESCRIPTION OF THE DRAWINGS

An exemplary embodiment of the present invention is illustrated in the drawings and will be described in greater detail below.

The drawings show.

DESCRIPTION OF THE PREFERRED EMBODIMENT

Figure 1:
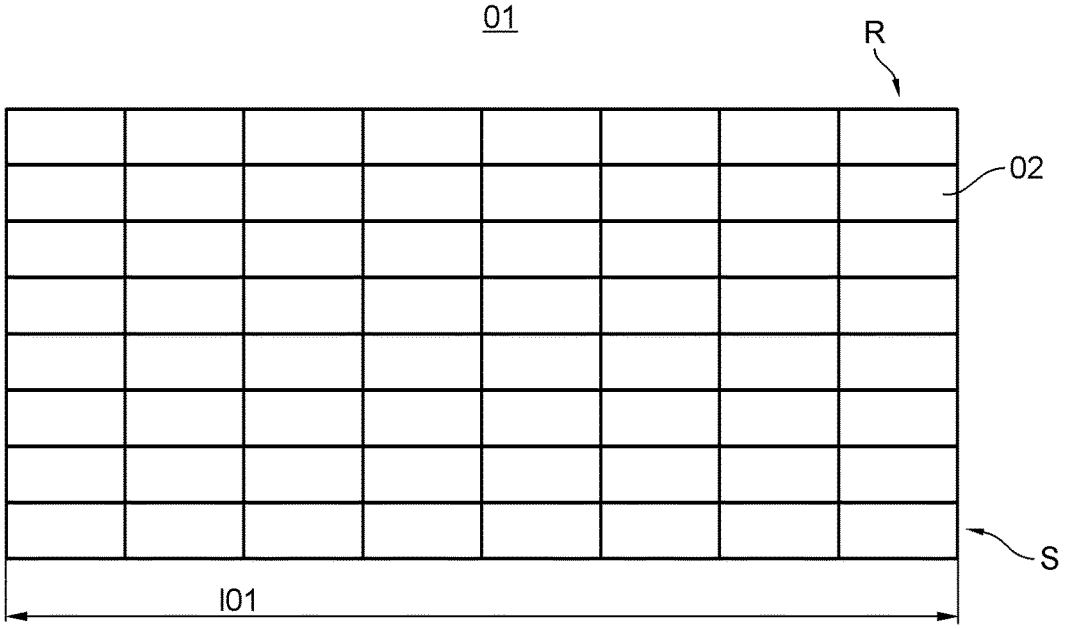
FIG. 1 a sheet including multiple banknotes.

FIG. 1, by way of example, illustrates that security documents that are needed in large quantities, in particular banknotes 02, are usually produced in an industrial process using a production panel format. The use of the multiple-up format means that, during the manufacturing process, multiple banknotes 02 are in each case arranged in a combination of rows R and columns S on a sheet 01 or on a material web, and these banknotes 02 are only detached from this combination at the end of their manufacturing process, and are thereby singulated. At the end of the manufacturing process, each of these banknotes 02 produced in the production panel is an autonomous product after singulation; however, a multiplicity of these typically identical products are jointly manufactured on the sheet 01 or on the material web so as to optimally utilize the surface area of the sheet 01 or of the material web, and thereby enable cost-effective mass production.

The banknotes 02 in general comprise a substrate 18 (FIG. 4), e.g., made of paper or plastic, in particular made of a polymer material, wherein this substrate 18 is preferably printed in one or more printing presses using several different printing methods. For example, an offset printing method and/or a gravure printing method, in particular the intaglio printing method, and/or a screen printing method and/or an ink jet printing method are used as printing methods. The banknotes 02 arranged in each case in columns S on the sheet 01 or on the material web are generally arranged lengthwise along the transport direction of the relevant sheet 01 or material web guided through the particular printing press, while the banknotes 02 arranged in rows R are generally arranged transversely to this transport direction.

Figure 2:
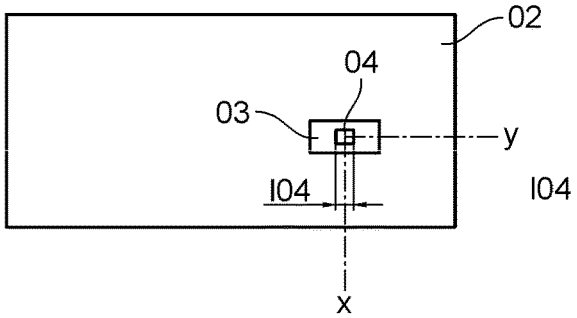
FIG. 2 a banknote including an integrated circuit arranged in an aperture.

To produce banknotes 02 including in each case at least one integrated electronic circuit 04, initially an aperture 03, which in each case perforates the substrate 18 of the relevant sheet 01 or of the relevant material web, is created at least in several, or preferably in each, of these banknotes 02, wherein such an aperture 03 is often also referred to as a window or an opening. The aperture 03 is created, e.g., by die cutting or cutting, in particular by laser cutting, wherein the contour of the relevant aperture 03 can be arbitrarily configured, but is usually configured in the form of a circle or a rectangle. FIG. 2, by way of example, shows a single copy of such a banknote 02.

Each of the integrated circuits 04 to be embedded into one of the banknotes 02 is encapsulated in a dedicated housing and is thus in each case configured as an autonomous component. As a result, each of the integrated circuits 04 to be embedded into one of the banknotes 02 is configured as a microchip. In the embodiment that is preferred here, the integrated circuit 04 to be embedded into the relevant banknote 02 is configured as a radio-frequency identification (RFID) tag, in particular as a capacitively coupled RFID tag, wherein a data exchange between the relevant integrated circuit 04 and an external transceiver, which is not shown, takes place in a non-contact manner. Each of these integrated circuits 04 has a generally rectangular format, in particular a square surface area having an edge length 104 of no more than 1 mm×1 mm, preferably of 0.5 mm×0.5 mm, wherein the structural height or thickness of these integrated circuits 04 to be embedded is no more than 90 μm, and preferably is in a range between 25 μm and 50 μm, and thus less than the material thickness of the substrate 18 of the relevant banknote 02. The aperture 03 to be created in the relevant banknote 02 is adapted to the format of the relevant integrated circuit 04 to be embedded, and its respective expansion is e.g., between 10% and 100% greater than the respective edge length 104 of the integrated circuit to be embedded. Information, e.g., about the currency and/or the value of the relevant banknote 02 and/or information about the issuing bank of this banknote 02 is stored in the respective integrated circuit 04, e.g., by appropriate programming, which can be read out elsewhere by means of the external transceiver (not shown) in a non-contact manner. Information as to whether this banknote 02 was already brought into circulation, or when this took place, can also be stored in the integrated circuit 04.

For the sake of simplicity and without limiting the invention, it is assumed hereafter that identical banknotes 02 are produced using the production panel, so that the respective aperture 03 in each of these banknotes 02 is in each case created in the same position, with respect to the relevant banknote 02. A center of the relevant aperture 03, and thus its position in the relevant banknote 02, with respect to, e.g., at least one boundary line, e.g., an edge or a lateral edge of the relevant sheet 01 or of the material web, e.g., is established in each case by corresponding coordinates x; y. These coordinates x; y are stored in a control processor, e.g., wherein this control processor provides the relevant coordinates x; y for each banknote 02 produced in the relevant production panel at least, e.g., to a cutting device 09 or a die-cutting device 28 (FIG. 4) creating the relevant aperture 03 in each case, on the one hand, and to a device providing the respective integrated circuits 04 on the other hand.

So as to arrange an integrated circuit 04 in each of the relevant apertures 03 of the banknotes 02 to be jointly produced in an industrial process, in a first method step the necessary number of integrated circuits 04 is arranged with register accuracy on a band-shaped foil 06 by the device providing the respective integrated circuits 04. An arrangement with register accuracy means that one of the integrated circuits 04 is in each case arranged in precisely such positions on the band-shaped foil 06 which correspond to the positions for the arrangement of the respective integrated circuit 04 that are established in each case on the relevant sheet 01 or the material web by the corresponding coordinates x; y. With this, the arrangement of the integrated circuits 04 on the band-shaped foil 06 in the lateral register and in the circumferential register corresponds precisely to the arrangement that is intended on the relevant sheet 01 or the material web.

Figure 3:
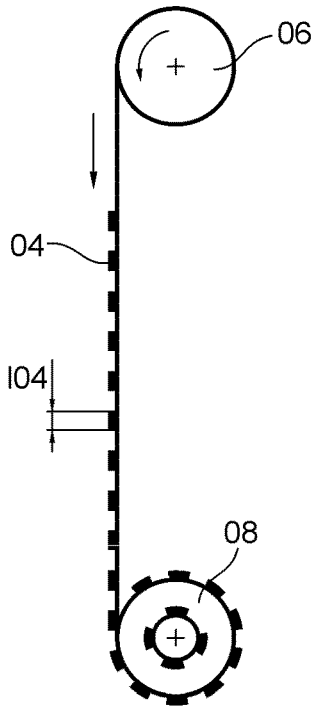
FIG. 3 a system for applying integrated circuits to a band-shaped foil in the correct position.

As is only schematically illustrated in FIG. 3 by way of example, the band-shaped foil 06 is preferably provided in the form of a material roll 07 and is unwound from the material roll 07, wherein the fed integrated circuits 04 are then arranged in the correct position, and thus with register accuracy, on the unwound part of the material roll 07, i.e., on the band-shaped foil 06. The integrated circuits 04 can be fed to the band-shaped foil 06, e.g., assisted by blower air. The integrated circuits 04 are fixed on the band-shaped foil 06, e.g., electrostatically and/or by way of adhesion. After the integrated circuits 04 have been adhesively arranged, the band-shaped foil 06 can, e.g., be wound onto a reel 08 again.

In a second method step, the band-shaped foil 06, after having been wound onto the reel 08 according to the described example, is unwound from the reel 08 again, wherein the integrated circuits 04 arranged with register accuracy on the band-shaped foil 06 are transferred from the band-shaped foil 06 to the respective banknotes 02 created on the relevant sheet 01 or the relevant material web, wherein, as a result of this transfer carried out in the second method step, one of the integrated circuits 04 is arranged in each of the apertures 03 created in the banknotes 02.

Figure 4:
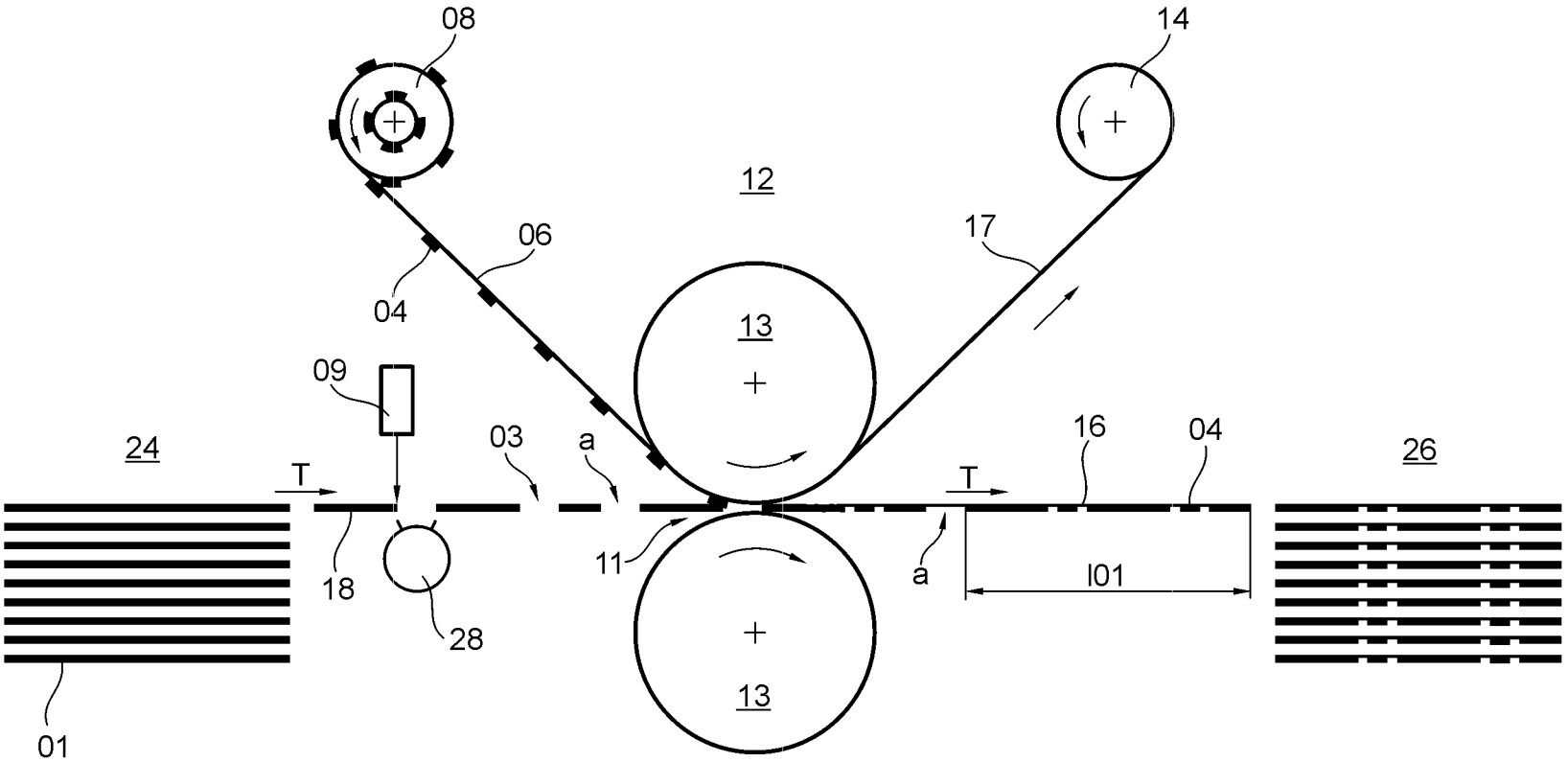
FIG. 4 a device for arranging the integrated circuits in the relevant apertures of the banknotes.

The application of the integrated circuits 04 in the banknotes 02 is illustrated in FIG. 4, wherein FIG. 4, by way of example, shows the application, in particular the arrangement of integrated circuits 04 in the respective apertures 03 of sheets 01 conveyed in the transport direction T, wherein each of these sheets 01 has a length 101 in the transport direction T. In the shown example, several of these sheets 01 are consecutively fed from a first pile 24 at a distance a in the transport direction T to a device 12 for applying the integrated circuits 04, and after the application has been carried out, are deposited in a second pile 26 again. So as to enable economical production, at least some processing steps are combined locally, i.e., carried out in the same machine system, so as to avoid temporarily storing the sheets 01. The sheets 01 or the material web are thus, initially, fed preferably continuously from the first pile 24 to a cutting device 09 or a die-cutting device 28, wherein the respective apertures 03 are created in the relevant sheet 01 or the material web by way of this cutting device 09 or die-cutting device 28. Thereafter, the sheets 01 or the material web provided with the apertures 03 are preferably fed in the same machine system to the device 12 for applying the integrated circuits 04, which, e.g., comprises a roller pair and which, in a roller nip of the cooperating rollers 13, transfers the integrated circuits 04 arranged on the band-shaped foil 06 from the band-shaped foil 06 onto the relevant banknote 02, wherein, as a result of this transfer, in each case one of the integrated circuits 04 is arranged in the apertures 03 created in the banknotes 02. This application preferably takes place simultaneously for all integrated circuits 04 arranged in the same row R. As a result of the banknotes 02, in the production panel, being produced with multiple columns S arranged next to one another, and to ensure that in each case multiple banknotes 02 are arranged in each row R extending across multiple rows S, a very high mass throughput can be achieved compared to a serial processing operation of individual banknotes 02. At least at the transfer point 11 located in the roller nip, the transport speed of the band-shaped foil 06 to be unwound from the reel 08, e.g., is synchronized with the transport speed of the sheets 01 or the material web.

As the second method step is being carried out, or immediately after the second method step has been carried out, the band-shaped foil 06 is joined to the substrate 18 of the banknotes 02 of the relevant sheet 01 or of the relevant material web. In a preferred embodiment for producing banknotes 02, the band-shaped foil 06, on which the integrated circuits 04 are arranged with register accuracy in the first method step, is configured as a two-layer foil, wherein as the second method step is being carried out, or immediately after the second method step has been carried out, a first layer 16 of the band-shaped foil 06 is joined to the substrate 18 of the banknotes 02 of the relevant sheet 01 or of the relevant material web. The band-shaped foil 06, or its first layer 16, is, for example integrally, joined in each case to the substrate 18 of the banknotes 02 of the relevant sheet 01 or of the relevant material web, in particular by adhesive bonding. The band-shaped foil 06, or the first layer 16 of the two-layer band-shaped foil 06, is preferably configured in each case as a foil including a hologram and/or a Kinegram, wherein a second layer 17 of the two-layer band-shaped foil 06 is, e.g., made of paper or a plastic. A Kinegram is a security feature having a tilt effect, which means that, depending on the angle at which the Kinegram is observed, a fixedly defined movie-like sequence occurs. In contrast to a hologram, which has three-dimensional elements, a Kinegram, which usually has a silvery shine, represents a two-dimensional sequence of motions. In particular a metallic foil or a metallized foil or a security foil to be arranged on the substrate 18 of the banknotes 02 is used in each case as the band-shaped foil 06 or as the first layer 16 of the two-layer band-shaped foil 06. For reasons related to ultimate tensile strength and/or stability and/or processability, the second layer 17, e.g., forms a carrier for the first layer 16. When the band-shaped foil 06 or its first layer 16 is configured as a metallic foil or as a metallized foil, this foil is, e.g., made of aluminum or of another metallic material, or this foil comprises a carrier, e.g., made of a plastic material, the surface of which was metallized, e.g., by vapor deposition. In each of these embodiments, the integrated circuits 04 to be applied adhere to the band-shaped foil 06 or to the first layer 16 of the two-layer band-shaped foil 06. However, no electrically conducting connection exists between the respective integrated circuit 04 and the metallic foil 06 or the metallized surface of this foil 06. The band-shaped foil 06, or its first layer 16, is in each case joined to the substrate 18 of the banknotes 02 of the relevant sheet 01 or of the relevant material web, e.g., by rolling-on or by hot stamping. During hot stamping, the band-shaped foil 06 or its first layer 16 is applied to the substrate 18 of the relevant sheet 01 or of the relevant material web under the action of pressure and heat. The two layers 16; 17 of the two-layer band-shaped foil 06 are preferably separated from one another at the transfer point 11 or immediately thereafter, wherein the second layer 17 is, e.g., again wound onto another reel 14.

Figure 5:
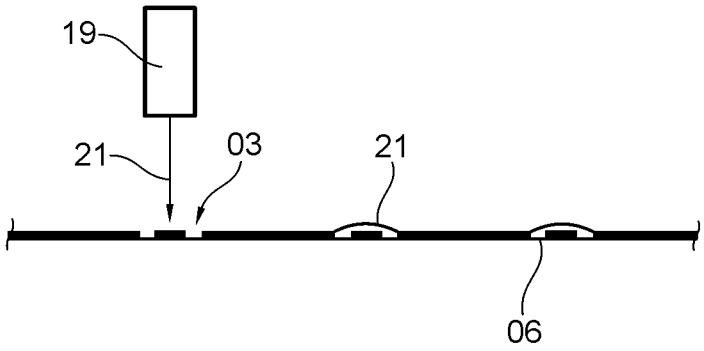
FIG. 5 a device for fixing the integrated circuit in one of the apertures, using an ink jet printing method.
Figure 6:
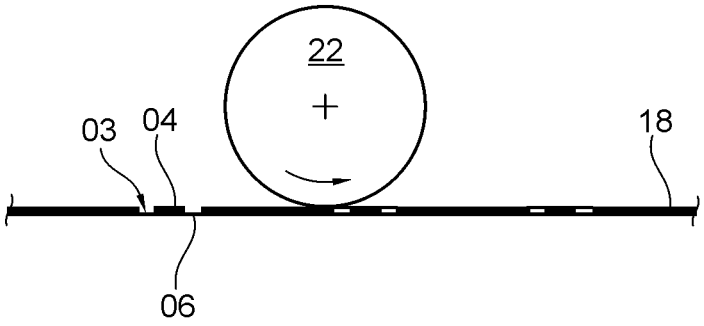
FIG. 6 a device for fixing the integrated circuit in one of the apertures, using a screen printing method.
Figure 7:
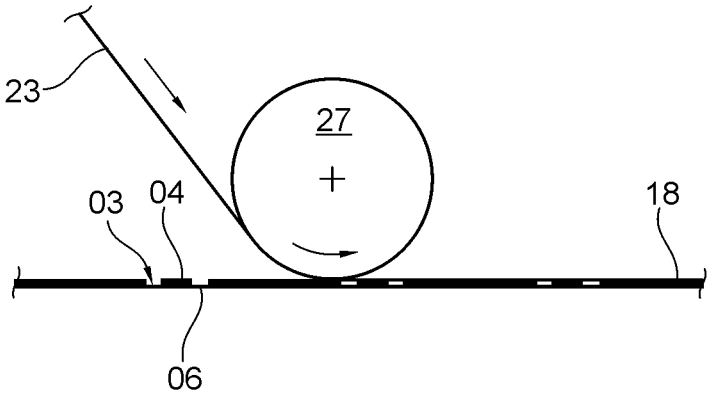
FIG. 7 a device for fixing the integrated circuit in one of the apertures by rolling on a cover foil.

In a third method step, the integrated circuits 04 applied or arranged in the respective apertures 03 are fixed therein. This fixation is carried out, e.g., using a printing method, in particular an ink jet printing method or a screen printing method, and/or by rolling or hot stamping a cover foil onto the substrate 18 of the relevant banknotes 02. FIG. 5 shows that an electrically non-conductive printing fluid 21, e.g., an ink or a coating, is applied to the integrated circuit 04 arranged in one of the apertures 03 by way of an ink jet printing device 19, wherein the integrated circuit 04 is fixed in the relevant aperture 03 by drying and/or curing the printing fluid 21. FIG. 6 illustrates by way of example that an electrically non-conductive printing fluid 21 is applied to the integrated circuit 04 arranged in one of the apertures 03, and thus in these apertures 03, by way of a screen printing device 22, wherein here as well the integrated circuit 04 is fixed in the relevant aperture 03 by drying and/or curing the printing fluid 21. As an alternative or in addition to applying a printing fluid 21, the integrated circuits 04 arranged in the apertures 03 can be fixed by applying an electrically non-conducting cover foil 23 onto the relevant banknotes 02, in particular by rolling it on by way of a rolling device 27, if necessary additionally under the action of heat, which is schematically shown in FIG. 7 in a drastically simplified manner.

After the integrated circuits 04 have been applied or arranged and fixed in the relevant apertures 03 of the banknotes 02, in general several of the sheets 01 or the material web, each comprising copies of the banknotes 02 to be produced in the production panel, are printed in at least one printing press, or using at least one printing method, and are thereafter detached from their combination by way of a die-cutting device or by way of a cutting device, e.g., a guillotine cutter, and are thereby singulated.

During the production of banknotes 02, at least two, preferably all, of the aforementioned method steps can take place inline, i.e., the first method step of arranging the integrated circuits 04 in the correct position or with register accuracy on the band-shaped foil 06 and/or the second method step of applying or arranging the integrated circuits 04 in the apertures 03 of the banknotes 02 and/or the third method step of fixing the integrated circuits 04 arranged in the apertures 03 and/or printing the sheets 01 including the banknotes 02 or printing the material web including the banknotes 02 and/or singulating the copies of the banknotes 02 produced in the production panel, preferably take place in the same production machine, in particular in a rotary printing press used in security printing.

While a preferred embodiment of a method for producing banknotes including, in each case, at least one integrated circuit, in accordance with the present invention, has been set forth fully and completely hereinabove, it will be apparent to one of skill in the art that various changes could be made thereto without departing from the true spirit and scope of the present invention which is accordingly to be limited only by the appended claims.

The invention claimed is:

1. A method for producing banknotes including, in each banknote, at least one integrated circuit, the banknotes being produced from a substrate including a sheet or a material web as a production panel, each banknote including an aperture through the substrate of the banknote and an integrated circuit arranged in the aperture of the banknote, the method comprising:

in a first method step, disposing a plurality of the integrated circuits on a band-shaped foil, wherein the integrated circuits are disposed on the band-shaped foil at respective positions corresponding to respective positions of the apertures in the banknotes, wherein the respective positions at which the integrated circuits are disposed on the band-shaped foil enables subsequent arrangement of one integrated circuit in each aperture of each banknote; and in a second method step, contacting the banknotes with the band-shaped foil having the plurality of integrated circuits disposed thereon to position the integrated circuits in the apertures of the banknotes, so that one integrated circuit is arranged in each aperture in each banknote, wherein at least one of:

information about a currency is stored in the integrated circuits;

information about a value of a corresponding banknote is stored in the integrated circuits;

information about an issuing bank of the banknotes is stored in the integrated circuits; or information as to whether a corresponding banknote was already brought into circulation, or when this took place, is stored in the integrated circuits.

2. The method according to claim 1, further comprising creating the apertures in the banknotes by die cutting or by laser cutting.

3. The method according to claim 1, wherein the integrated circuits are configured as at least one of: a microchip encapsulated in a dedicated housing, or a radio frequency identification (RFID) tag.

4. The method according to claim 1, wherein the integrated circuits have at least one of:

a surface area having an edge length of no more than 1 mm×1 mm;

a structural height of no more than 90 μm; or a structural height in a range between 25 μm and 50 μm.

5. The method according to claim 1, wherein the aperture in each banknote has a length between 10% and 100% greater than an edge length of the integrated circuit.

6. The method according to claim 1, further comprising, in the first method step, at least one of:

disposing the integrated circuits on the band-shaped foil assisted by blower air; or disposing the integrated circuits on the band-shaped foil at least one of electrostatically or by way of adhesion.

7. The method according to claim 1, further comprising, as the second method step is being carried out, or immediately after the second method step has been carried out, joining the band-shaped foil to the substrate of the banknotes.

8. The method according to claim 1, wherein a two-layer foil is used as the band-shaped foil, the method further comprising, as the second method step is being carried out, or immediately after the second method step has been carried out, joining a first layer of the band-shaped foil to the substrate of the banknotes, the integrated circuits adhering to the first layer, and separating a second layer of the two-layer foil from the first layer.

9. The method according to claim 8, wherein the second layer of the two-layer foil is made of paper or a plastic.

10. The method according to claim 1, further comprising at least one of:

using a foil including at least one of a hologram or a diffractive optically variable image device as the band-shaped foil;

using a metallic foil or a metallized foil as the band-shaped foil; or using a security foil to be arranged on the substrate of the banknotes as the band-shaped foil.

11. The method according to claim 1, further comprising, in a third method step, using a printing method to fix the integrated circuits in the apertures.

12. The method according to claim 11, wherein the printing method comprises applying an electrically non-conducting printing fluid by at least one of an ink jet printing method, or a screen printing method.

13. The method according to claim 1, further comprising, in a third method step, fixing the integrated circuits in the apertures by rolling or hot stamping a cover foil onto the substrate of the banknotes.

14. The method according to claim 1, wherein at least two method steps are performed inline in a same production machine during production of the banknotes, the at least two method steps including at least two of:

the first method step;

the second method step;

a third method step of fixing the integrated circuits in the apertures;

a printing method step including printing the sheets including the banknotes or printing the material web including the banknotes; or a singulating method step of singulating the banknotes produced in the production panel.

* * * * *